US007288353B2

(12) United States Patent
Sugiura et al.

(10) Patent No.: US 7,288,353 B2
(45) Date of Patent: Oct. 30, 2007

(54) TONER, DEVELOPER, IMAGE DEVELOPER AND IMAGE FORMING APPARATUS

(75) Inventors: Hideki Sugiura, Fuji (JP); Satoshi Mochizuki, Numazu (JP); Yasuaki Iwamoto, Numazu (JP); Yasuo Asahina, Numazu (JP); Kazuhiko Umemura, Suntou-gun (JP); Tomoyuki Ichikawa, Numazu (JP); Shinya Nakayama, Numazu (JP); Koichi Sakata, Numazu (JP); Tomoko Utsumi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 14 days.

(21) Appl. No.: 10/759,029

(22) Filed: Jan. 20, 2004

(65) Prior Publication Data

US 2005/0191575 A1 Sep. 1, 2005

(30) Foreign Application Priority Data

Jan. 20, 2003 (JP) ..... 2003-010902

(51) Int. Cl.
*G03G 9/08* (2006.01)

(52) U.S. Cl. ..... 430/110.3; 430/110.1; 430/110.4

(58) Field of Classification Search ..... 430/110.3, 430/110.4, 108.1, 110.1; 399/252
See application file for complete search history.

(56) References Cited

U.S. PATENT DOCUMENTS

| | | | | |
|---|---|---|---|---|
| 5,547,802 | A * | 8/1996 | Kawase et al. | 430/108.24 |
| 5,912,100 | A | 6/1999 | Aoki et al. | |
| 5,976,747 | A * | 11/1999 | Sato et al. | 430/111.31 |
| 6,004,715 | A | 12/1999 | Suzuki et al. | |
| 6,080,519 | A * | 6/2000 | Ishiyama et al. | 430/110.3 |
| 6,308,027 | B1 | 10/2001 | Obu et al. | 399/110 |
| 6,542,707 | B2 | 4/2003 | Muramatsu et al. | 399/258 |
| 6,597,883 | B2 | 7/2003 | Muramatsu et al. | 399/258 |
| 6,628,908 | B2 | 9/2003 | Matsumoto et al. | 399/106 |
| 6,628,913 | B2 | 9/2003 | Matsumoto et al. | 399/258 |
| 6,630,276 | B2 | 10/2003 | Sugiura et al. | 430/108.3 |
| 6,667,141 | B2 | 12/2003 | Iwamoto et al. | 430/111.4 |
| 6,674,982 | B2 | 1/2004 | Saitoh et al. | 399/110 |
| 6,697,584 | B2 | 2/2004 | Tsunoda et al. | 399/91 |
| 2003/0118366 | A1 * | 6/2003 | Nukada et al. | 399/109 |
| 2003/0134220 | A1 * | 7/2003 | Emoto et al. | 430/109.4 |
| 2003/0152859 | A1 * | 8/2003 | Emoto et al. | 430/109.4 |
| 2003/0180644 | A1 * | 9/2003 | Nanya et al. | 430/108.22 |
| 2004/0115550 | A1 * | 6/2004 | Sugiura et al. | 430/109.4 |

FOREIGN PATENT DOCUMENTS

| | | | |
|---|---|---|---|
| EP | 1 283 236 | | 2/2003 |
| JP | 9-179331 | | 7/1997 |
| JP | 09-197716 | * | 7/1997 |
| JP | 10-142835 | | 5/1998 |
| JP | 11-327197 | | 11/1999 |
| JP | 2001-51444 | | 2/2001 |

OTHER PUBLICATIONS

Japanese Patent Office machine-assisted translation of JP 09-197716 (pub. Jul. 1997).*
USPTO English-language translation of JP 9-197716 (pub. Jul. 1997).*
U.S. Appl. No. 09/964,584, filed Sep. 28, 2001, Shinkai et al.
U.S. Appl. No. 10/020,925, filed Dec. 19, 2001, Mochizuki et al.
U.S. Appl. No. 10/059,240, filed Jan. 31, 2002, Sugiura et al.
U.S. Appl. No. 10/059,239, filed Jan. 31, 2002, Mochizuki et al.
U.S. Appl. No. 10/086,415, filed Mar. 4, 2002, Sugiura et al.
U.S. Appl. No. 10/077,813, filed Feb. 20, 2002, Higuchi et al.
U.S. Appl. No. 10/101,994, filed Mar. 21, 2002, Ueda.
U.S. Appl. No. 10/101,756, filed Mar. 21, 2002, Sasaki et al.
U.S. Appl. No. 10/107,157, filed Mar. 28, 2002, Masuda et al.
U.S. Appl. No. 10/151,103, filed May 21, 2002, Kondo.
U.S. Appl. No. 10/153,627, filed May 24, 2002, Suzuki et al.
U.S. Appl. No. 10/176,578, filed Jun. 24, 2002, Yagi et al.
U.S. Appl. No. 10/212,736, filed Aug. 7, 2002, Sugiura et al.
U.S. Appl. No. 10/231,281, filed Aug. 30, 2002, Kosuge.
U.S. Appl. No. 10/293,336, filed Nov. 14, 2002, Saito et al.
U.S. Appl. No. 10/318,109, filed Dec. 13, 2002, Sugiura et al.

(Continued)

*Primary Examiner*—Janis L. Dote
(74) *Attorney, Agent, or Firm*—Oblon, Spivak, McClelland, Maier & Neustadt, P.C.

(57) ABSTRACT

A toner including toner particles including a binder resin, a colorant, and an inorganic particulate material present on a surface of the toner particles. The toner particles have a surface roughness (Ra) of from 1 to 30 nm, a standard deviation of the surface roughness of from 10 to 90 nm and include 1 to 20 convexities per 1 μm, which have a height not less than 10 nm.

17 Claims, 1 Drawing Sheet

OTHER PUBLICATIONS

U.S. Appl. No. 10/329,538, filed Dec. 27, 2002, Higuchi et al.
U.S. Appl. No. 10/383,750, filed Mar. 10, 2003, Nakai et al.
U.S. Appl. No. 10/385,719, filed Mar. 12, 2003, Sugiura et al.
U.S. Appl. No. 10/391,575, filed Dec. 20, 2003, Suzuki et al.
U.S. Appl. No. 10/417,169, filed Apr. 17, 2003, Fukuchi.
U.S. Appl. No. 10/441,105, filed May 20, 2003, Kasahara et al.
U.S. Appl. No. 10/454,689, filed Jun. 5, 2003, Matsumoto et al.
U.S. Appl. No. 10/607,014, filed Jun. 27, 2003, Tomita et al.
U.S. Appl. No. 10/609,399, filed Jul. 1, 2003, Katoh et al.
Derwent Publications, AN 1994-276351, XP-002274877, JP 06-208247, Jul. 26, 1994.
Derwent Publications, AN 1992-014364, XP-002274878, JP 03-265863, Nov. 26, 1991.
Derwent Publications, AN 1990-265838, XP-002274927, JP 02-187768, Jul. 23, 1990.
U.S. Appl. No. 11/558,736, filed Nov. 10, 2006, Uchinokura et al.
U.S. Appl. No. 11/573,251, filed Feb. 5, 2007, Utsumi et al.

* cited by examiner

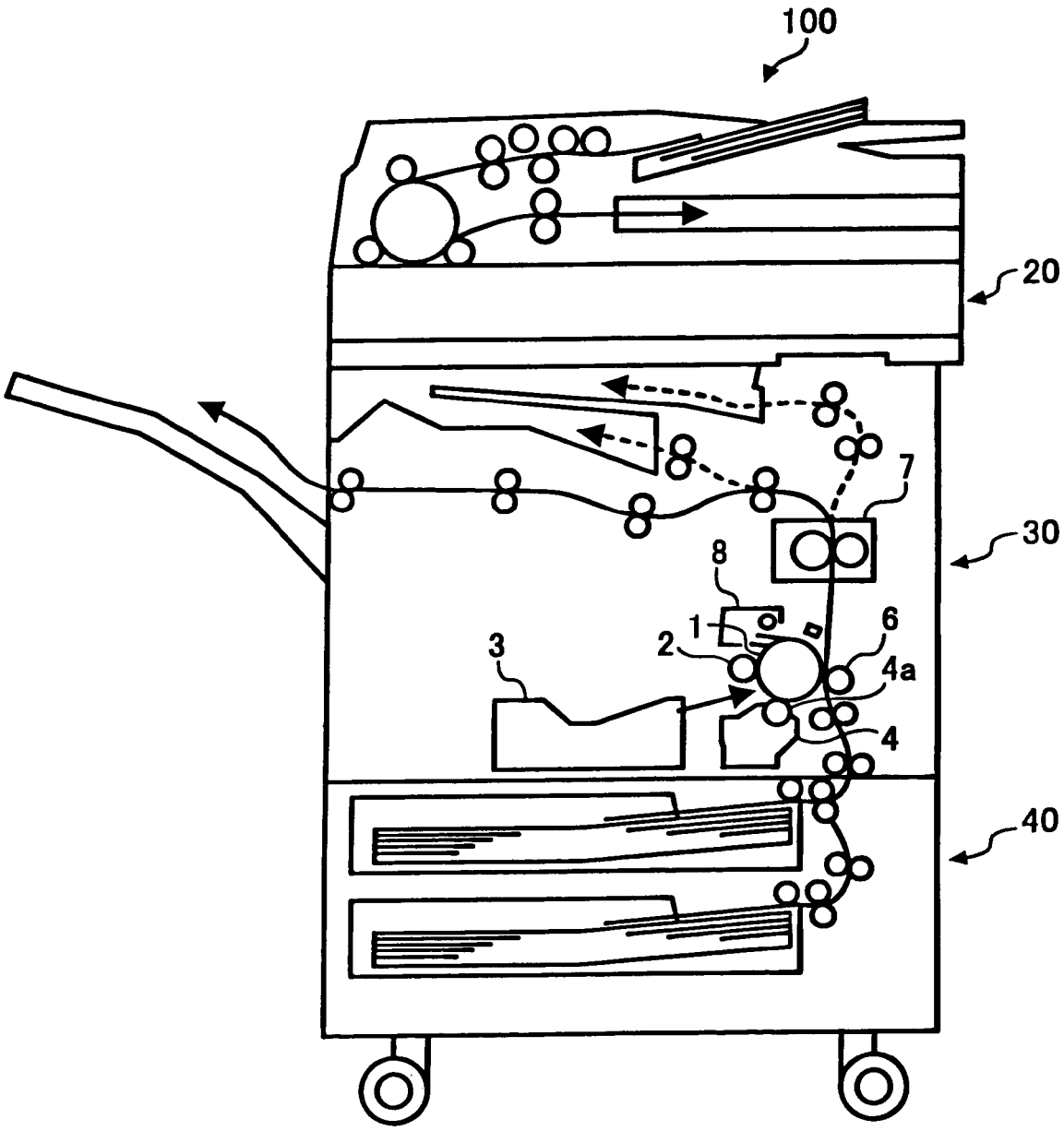
100
20
30
40
7
8
1
2
3
6
4a
4

TONER, DEVELOPER, IMAGE DEVELOPER AND IMAGE FORMING APPARATUS

BACKGROUND OF THE INVENTION

1. Field of the Invention

The present invention relates to a toner and a developer for use in copiers, facsimiles and printers using electrophotographic image forming methods.

2. Discussion of the Background

The electrophotographic image forming method includes a charging process charging a surface of a photoreceptor which is an image bearer with an electric discharge, an irradiating process irradiating the charged surface of the photoreceptor to form an electrostatic latent image, a developing process developing the electrostatic latent image formed on the surface of the photoreceptor with a toner to form a toner image, a transfer process transferring the toner image on the surface of the photoreceptor onto a surface of a transfer body, a fixing process fixing the toner image on the surface of the transfer body and a cleaning process removing the toner remaining on the surface of the image bearer after the transfer process.

Recently, color image forming apparatuses using the electrophotographic image forming method are widely used, and digitalized images are available with ease and printed images are required to have higher image definitions. While higher image resolution and gradient are studied, the toner visualizing the latent image is studied to have further sphericity and smaller particle diameter to form a high definition images. As the toner prepared by pulverizing methods has a limit of these properties, polymerized toners prepared by suspension polymerizing methods, emulsification polymerizing methods and dispersion polymerizing methods capable of conglobating the toner and making the toner have a small particle diameter are being used.

The toner having a shape close to a true sphere is easily affected by a line of electric force in an electrostatic developing method and is faithfully developed along the line of electric force of an electrostatic latent image on a photoreceptor. When a minute latent image dot is reproduced, the toner are precisely and uniformly located to have a high thin line reproducibility. In an electrostatic transfer method, as the toner has a smooth surface and a good powder fluidity, the toner particles less adhere each other and to the photoreceptor, and therefore the toner is easily affected by a line of electric force and is faithfully transferred along the line of electric force, i.e., the toner has a high transferability.

However, the toner having a shape close to a true sphere has a smaller surface area than an amorphous toner, i.e., has less surface area which can effectively used for frictional charge by a magnetic carrier and friction charging members such as developer regulating members. The spheric toner easily slip on a surface of the friction charging member and charged speed and level thereof decrease, and therefore a specific amount or more of a charge controlling agent is needed therefor.

In addition, as the toner having a smaller particle diameter to improve minute dot reproducibility has a lower friction chargeability, it is essential for the toner to have chargeability, developability and transferability.

Japanese Laid-Open Patent Publications Nos. 9-179331, 10-142835 and 11-327197 discloses various methods of controlling the shape of a spheric toner and a toner having a small particle diameter. Shape factors SF-1 and SF-2 are mostly used as indices to represent the shape of a toner. The SF-1 is an index representing roundness of the toner particle and the SF-2 is an index representing concavity and convexity thereof. Either of the SF-1 and SF-2 or both thereof are specified to control the shape of a toner and even a spheric toner or a toner having a small particle diameter is tried to have the chargeability, developability, transferability and cleanability.

Japanese Laid-Open Patent Publication No. 2001-51444 specifies a surface area ratio having the following formula as well as the shape factors of the toner particles:

$$\text{surface area ratio}=\rho\times D_{50p}\times S$$

wherein ρ is a specific gravity of the toner particle ($g/m^3$), $D_{50p}$ is a number-average particle diameter (m) thereof and S is a BET specific surface area ($m^3/g$) thereof. The surface area ratio represents the concavity and convexity of the toner particle in a different scale from that of the shape factor. When the surface area ratio is greater than the specified range, the concavity and convexity on a surface of the toner particle become large and an external additive externally added thereto enters the concave with time, and therefore the chargeability and transferability cannot be maintained for a long time.

As mentioned above, trials to improve the chargeability, developability, transferability and cleanability of the toner are made by controlling the shape of the toner particle. However, any of the trials roughly sees the surface shape of the toner particle and does not microscopically see the concavity and convexity.

Because of these reasons, a need exists for a spheric toner having a small particle diameter, which has good chargeability, developability and transferability.

SUMMARY OF THE INVENTION

Accordingly, an object of the present invention is to provide a spheric toner having a small particle diameter, which has good chargeability, developability and transferability by controlling microscopic concavity and convexity on a surface of the toner particle, and a developer including the toner.

Another object of the present invention is to provide an image developer and an image forming apparatus using the toner or developer.

Briefly these objects and other objects of the present invention as hereinafter will become more readily apparent can be attained by a toner including toner particles including:

a binder resin;

a colorant; and an inorganic particulate material present on a surface of the toner particles, wherein the toner particles have a surface roughness (Ra) of from 1 to 30 nm, a standard deviation of the surface roughness of from 10 to 90 nm and include 1 to 20 convexities per 1 μm, which have a height not less than 10 nm, and include a convexity having a vertical interval not less than 10 nm between a bottom of a concavity and a top of the convexity between 1 and 20 pieces/μm in number.

The toner preferably has an average circularity of from 0.93 to 1.00.

Particles of the toner having a circularity less than 0.93 is preferably included in an amount not greater than 30%.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a schematic view illustrating an embodiment of the image forming apparatus of the present invention.

DETAILED DESCRIPTION OF THE INVENTION

Generally, the present invention provides a toner including at least a binder resin and a colorant, wherein an inorganic particulate material is adhered to a toner particle having the following surface properties:

a surface roughness (Ra) of from 1 to 30 nm;

a standard deviation RMS of the surface roughness of from 10 to 90 nm; and a convexity having a vertical interval not less than 10 nm between a bottom of a concavity and a top of the convexity of 1 to 20 pieces/μm in number.

A surface status of the toner particle can be analyzed by an atomic force microscope (AFM). The AFM precisely scans and control a probe or a sample with a scanner using a piezoelectric element in the three-dimensional direction and detects a force between the probe and sample as an interaction to obtain a concave and convex image on a surface of the sample. While scanning the surface of the sample (a XY flat surface) with the probe and performing a feed-back control of a distance of the probe from the sample (a height of a Z axis) so as to stabilize the interaction, the AFM traces the surface of the sample. In the present invention, 1 μm square on the surface of the toner particle is traced to see a three-dimensional surface roughness thereof and the surface status of the toner particle is specified.

The surface roughness Ra is defined by a three-dimensional average roughness against a central surface, i.e., volumes of concavities and convexities separated by this flat surface are equal, and represented by the following formula (I)

$$R_a = \frac{\sum_{i=1}^{N} |Z_i - Z_{cp}|}{N} \quad \text{(I)}$$

wherein $Z_{cp}$ represents z-value, $Z_i$ represents z-value of each data point and N represents the number of data points.

The standard deviation RMS is a standard deviation o z-values of all the data points and represented by the following formula (II):

$$RMS = \sqrt{\frac{\sum_{i=1}^{N} (Z_i - Z_{ave})^2}{N}} \quad \text{(II)}$$

wherein $Z_{ave}$ represents an average value of all the z-values, $Z_i$ represents z-value of each data point and N represents the number of data points.

The surface roughness Ra is a average surface roughness, and when volumes of concavities and convexities formed by the central surface and surface shape are equal, the surface roughness Ra is the same. On the other hand, the standard deviation RMS can represent a coarse density of the concavity and convexity.

The toner particle of the present invention has a surface roughness Ra of from 1 to 30 nm. When the surface roughness Ra is less than 1 nm, the concavity and convexity of the toner particle is so small that the resultant toner is not frictionally charged well because the toner slips when contacting a magnetic carrier and a friction charging member such as a developer regulating member. When the Ra is greater than 30 nm, the toner particle has large concavities and convexities, and therefore fluidity and transferability of the resultant toner deteriorate.

The toner particle of the present invention has a standard deviation of the surface roughness RMS of from 10 to 90 nm. When the standard deviation of the surface roughness RMS is less than 10 nm, the concavity and convexity of the toner particle is so coarse that the resultant toner is not frictionally charged well when contacting the friction charging member. When the RMS is greater than 90 nm, concavities and convexities on the surface of the toner particle become so dense that fluidity of the resultant toner deteriorates.

The toner particle of the present invention has a convexity having a vertical interval not less than 10 nm between a bottom of a concavity and a top of the convexity of 1 to 20 pieces/μm in number. When the number of the convexity is less than 1 piece/μm, a surface of the toner particle is so smooth that the resultant toner is not frictionally charged well because the toner tends to slip when frictionally charged. A distance between the convexities is long and inorganic fine particles easily enter the concave portion. When the number of the convexity is greater than 20 pieces/μm, the toner particle has so many concavities and convexities that fluidity and transferability of the resultant toner deteriorate.

The toner of the present invention includes an inorganic particulate material in addition to the toner particle having the above-mentioned surface properties. Specific examples of the inorganic particulate material include silica, alumina, titanium oxide, barium titanate, magnesium titanate, calcium titanate, strontiumtitanate, zincoxide, tinoxide, quartz sand, clay, mica, sand-lime, diatomearth, chromiumoxide, ceriumoxide, red iron oxide, antimony trioxide, magnesium oxide, zirconium oxide, barium sulfate, barium carbonate, calcium carbonate, silicon carbide, silicon nitride, etc. These can be used alone or in combination to improve fluidity, developability and chargeability of the resultant toner.

The inorganic particulate material preferably has a primary particle diameter of from $5\times10^{-3}$ to 2 μm, and more preferably from $5\times10^{-3}$ to 0.5 μm. In addition, a specific surface area of the inorganic particulates measured by a BET method is preferably from 20 to 500 $m^2/g$. The content of the external additive is preferably from 0.0.01 to 5% by weight, and more preferably from 0.01 to 2.0% by weight, based on total weight of the toner.

The toner particle preferably has an average circularity of from 0.93 to 1.00 in terms of high quality images because the resultant toner has good dot reproducibility and transferability. The toner having such a high average circularity tends to slip on a surface of a friction charging member and has disadvantages for its charged speed and level. However, when the toner particle has the above-mentioned surface properties, the resultant toner has sufficient friction chargeability, good developability and good transferability.

When the toner has a circularity les than 0.93 and is apart from a sphere, the resultant toner has difficulty in having sufficient transferability and producing high quality images without a toner dust.

Such an amorphous particle has many contact points to a smooth medium such as photoreceptors and charges concentrated on an end of its projection cause a van der Waals force and a mirror image force, and therefore has higher adherence thereto than comparatively a spheric particle.

Therefore, in an electrostatic transfer process, spheric particles from a toner in which the amorphous and spheric particles are mixed are selectively transferred, resulting in defective letter and line images. Further, a cleaner is needed to remove the residual toner to use the toner for the following developing process or a toner yield, i.e., a ratio of the toner used for forming images is lowers.

A peripheral length of a circle having an area equivalent to that of a projected image optically detected is divided by an actual peripheral length of the toner particle to determine the circularity of the toner. Specifically, the circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

A ratio of the toner particle having a circularity less than 0.93 is preferably not greater than 30% in addition to the average circularity within the above range. When the ratio is greater than 30%, charged speed and level of the resultant toner vary and charged amount distribution thereof widens.

In the present invention, the toner preferably has a volume-average particle diameter (Dv) of from 2.0 to 6.0 μm and a ratio (Dv/Dn) between the volume-average particle diameter and a number-average particle diameter (Dn) of from 1.00 to 1.40, and more preferably has a volume-average particle diameter (Dv) of from 3.0 to 6.0 μm and a ratio (Dv/Dn) between the volume-average particle diameter and the number-average particle diameter (Dn) of from 1.00 to 1.15. Such a toner has good heat resistant preservability, low-temperature fixability and hot offset resistance. Above all, the toner used in full color copiers produce images having good glossiness.

Typically, it is said that the smaller the toner particle diameter, the more advantageous to produce high resolution and quality images. However, the small particle diameter of the toner is disadvantageous thereto to have transferability and cleanability. When the volume-average particle diameter is smaller than 4 μm, the resultant toner in a two-component developer melts and adheres to a surface of a carrier to deteriorate chargeability thereof when stirred for a long time in an image developer. When the toner is used in a one-component developer, toner filming over a developing roller and fusion bond of the toner to a blade forming a thin layer thereof tend to occur.

These phenomena largely depends on a content of a fine powder, and particularly when a ratio of a toner having a particle diameter not greater than 3 μm is greater than 10%, adherence to a magnetic carrier of the toner occurs and charged stability thereof deteriorates.

When the volume-average particle diameter is larger than 6 μm, the resultant toner has a difficulty in producing high resolution and quality images. In addition, the resultant toner has a large variation of the particle diameters in many cases when the toner in a developer is fed and consumed.

When Dv/Dn is greater than 1.40, charged amount distribution of the resultant toner widens and the toner produces images having deteriorated image resolution.

The average particle diameter and particle diameter distribution of the toner can be measured by a COULTER COUNTER TA-II and Coulter Multisizer II from Beckman Coulter, Inc. In the present invention, an Interface producing a number distribution and a volume distribution from Nikkaki Bios Co., Ltd. and a personal computer PC9801 from NEC Corp. are connected with the Coulter Multisizer II to measure the average particle diameter and particle diameter distribution.

A ratio RA(nm)/Dv(μm) between the surface roughness Ra and volume-average particle diameter Dv of the toner is preferably from 0.2 to 6.0. When the ratio is less than 0.2, since concavity and convexity of the toner particle is small compared with the particle diameter thereof, the toner particle tends to slip on a surface of a friction charging member and chargeability thereof deteriorates. When the ratio is greater than 6.0, since the concavity and convexity of the toner particle is large compared with the particle diameter thereof, the toner particle is strongly frictionized and tends to be spent.

In the present invention, the toner preferably has a shape factor SF-2 of from 100 to 140 and a ratio Ra(nm)/SF-2 of from 0.007 to 0.30.

SF-2 represents the concavity and convexity of the shape of the toner, and is determined by photographing the toner with a scanning electron microscope (S-800) from Hitachi, Ltd. and analyzing the photographed image of the toner with an image analyzer Luzex III from NIRECO Corp. Compared with an analysis of the surface roughness Ra, macro concavity and convexity is analyzed. Specifically, a square of a peripheral length of an image projected on a two-dimensional flat surface (PERI) is divided by an area of the image (AREA) and multiplied by 100 π/4 to determine SF-2 as the following formula (III) shows.

$$SF\text{-}2=\{(PERI)^2/AREA\}\times(100\pi/4) \quad \text{(III)}$$

When SF-2 is 100, the shape of the toner does not include the macro concavity and convexity. The larger SF-2, the more noticeable the concavity and convexity of the shape of the toner. When SF-2 is greater than 140, the tone scatters on the resultant images.

A ratio between the surface roughness Ra representing a microscopic concavity and convexity on the surface of the toner particle and SF-2 representing a macro concavity and convexity of the shape of the toner particle Ra(nm)/SF-2 is preferably from 0.007 to 0.30. The toner within this range has good frictional chargeability because of having moderate microscopic concavities and convexities on the surface thereof and has good developability and transferability because of being almost spheric, and therefore the toner produces high quality images.

The toner of the present invention is granulated in a liquid medium. A toner produced by a dry pulverizing method has an amorphous shape and a wide particle diameter distribution. Therefore, it is preferable to produce a toner in a liquid medium to narrow circularity, particle diameter and charge amount distributions of the toner. Specifically, a method of granulating a toner by forming a droplet in the liquid medium using suspension polymerizing methods, emulsification polymerizing methods and dispersion polymerizing methods. To control the surface roughness Ra of the toner particle, a different resin from a toner binder resin is preferably adhered onto the surface thereof. Any thermoplastic and thermosetting resins capable of forming an aqueous dispersion can be used as the different resin from the toner binder resin. Specific examples of the resins include vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These can be used alone or in combination. Among these resins, the vinyl resins, polyurethane resins, epoxy resin, polyester resins or combinations of these resins are preferably used because an aqueous dispersion of a fine-spherical particulate resin material can easily be obtained. Specific examples of the vinyl resins include single-polymerized or copolymerized vinyl monomers such as styrene-ester(metha)acrylate resins, styrene-butadiene copolymers, (metha)acrylic acid-esteracrylate polymers, styrene-acrylonitrile copolymers, styrene-maleic acid anhydride copolymers and styrene-(metha)acrylic acid copolymers.

When a toner composition dissolved or dispersed in an organic solvent, which includes the above-mentioned resin, is dispersed in a liquid medium, the particulate resin adheres around a present oil droplet to prevent coalescence of the oil droplets and to produce an oil droplet having a uniform particle diameter. An amount of the resins and a particle diameter of the particulate resin can control the surface roughness of the toner particle.

The particulate resin preferably has a volume-average particle diameter of from 20 to 150 nm because such particulate resins easily adhere to the toner particle and the surface profile thereof of the present invention is preferably formed.

Further, the particulate resin preferably has the shape of a sphere, or a spindle, a disk, a spindle disk, an amorphous flat plate or a mixed shape thereof because such particulate resins easily adhere to the toner particle and the surface profile thereof of the present invention is preferably formed as well. Among these shapes, the shape of a sphere is particularly preferable for the particulate resin in terms of granularity of the resultant toner, such as average particle diameter, particle diameter distribution and shape controllability thereof, although the other shapes have a slight drawback in terms of the granularity.

A release agent is optionally included in the toner to prevent hot offset of the toner n a fixing process. The release agent included in the toner receives a heat and a pressure when the toner is fixed and appears on the surface of the toner in accordance with a deformation thereof to have releasability. The release agent is preferably involved in the toner without being exposed on the surface of the toner. A wax exposed on the surface of the toner adheres onto a surface of a friction charging member to deteriorate friction chargeability of the toner and agglutinates to deteriorate fluidity of the toner.

When the above-mentioned particulate resin is adhered onto the surface of the toner particle, the release agent included in the toner only exudes when the toner is fixed.

A wax for use in the toner of the present invention has a low melting point of from 50 to 120° C. When such a wax is included in the toner, the wax is dispersed in the binder resin and serves as a release agent at a location between a fixing roller and the toner particles. Thereby, hot offset resistance can be improved without applying an oil to the fixing roller used. Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

The toner of the present invention is preferably formed by a crosslinking and/or an elongation reaction of a toner constituent liquid including at least polyester prepolymer having a functional group including a nitrogen atom, polyester, a colorant and a release agent are dispersed in an organic solvent in an aqueous medium. Hereinafter, the toner constituents will be explained.

The polyester can be formed by a polycondensation reaction between a polyol compound and a polycarbonate compound.

As the polyol (PO), diol (DIO) and triol (TO) can be used, and the DIO alone or a mixture of the DIO and a small amount of the TO is preferably used.

Specific examples of the DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used.

Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylicacid (TC) can be used. The DIC alone, or a mixture of the DIC and a small amount of the TC are preferably used.

Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylenedicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polycondensation reaction between the PO and PC is performed by heating the Po and PC at from 150 to 280° C. in the presence of a known esterification catalyst such as tetrabutoxytitanate and dibutyltinoxide and removing produced water while optionally depressurizing to prepare polyester having a hydroxyl group. The polyester preferably has a hydroxyl value not less than 5, and an acid value of from 1 to 30 and more preferably from 5 to 20. When the polyester has an acid value within the range, the resultant toner tends to be negatively charged to have good affinity with a recording paper and low-temperature fixability of the toner on the recording paper improves. However, when the acid value is greater than 30, the resultant toner is not stably charged and the stability becomes worse by environmental variations.

The polyester preferably has a weight-average molecular weight of from 10,000 to 400,000, and more preferably from 20,000 to 200,000. When the weight-average molecular weight is less than 10,000, offset resistance of the resultant toner deteriorates. When greater than 400,000, low-temperature fixability thereof deteriorates.

The polyester preferably includes a urea-modified polyester besides an unmodified polyester formed by the above-mentioned polycondensation reaction. The urea-modified polyester is formed by reacting a polyisocyanate compound (PIC) with a carboxyl group or a hydroxyl group at the end of the polyester formed by the above-mentioned polycondensation reaction to form a polyester prepolymer (A) having an isocyanate group, and reacting amine with the polyester prepolymer (A) to crosslink and/or elongate a molecular chain thereof.

Specific examples of the PIC include aliphatic polyisocyanate such as tetramethylenediisocyanate, hexamethylenediisocyanate and 2,6-diisocyanatemethylcaproate; alicyclicpolyisocyanate such as isophorondiisocyanate and cyclohexylmethanediisocyanate; aromatic diisocyanate such as tolylenedisocyanate and diphenylmethanediisocyanate; aroma aliphatic diisocyanate such as α, α,α',α'-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 11.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

A content of the PIC in the polyester prepolymer (A) having a polyisocyanate group is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) reacted with the polyester prepolymer (A) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorondiamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

The urea-modified polyester may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The urea-modified polyester can be prepared by a method such as a one-shot method. The PO and PC are heated at from 150 to 280° C. in the presence of a known esterification catalyst such as tetrabutoxytitanate and dibutyltinoxide and removing produced water while optionally depressurizing to prepare polyester having a hydroxyl group. Next, the polyisocyanate is reacted with the polyester at from 40 to 140° C. to form a polyester prepolymer (A) having an isocyanate group. Further, the amines (B) are reacted with the (A) at from 0 to 140° C. to form a urea-modified polyester.

When the PIC, and (A) and (B) are reacted, a solvent may optionally be used. Specific examples of the solvents include inactive solvents with the PIC such as aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

A reaction terminator can optionally be used in the crosslinking and/or elongation reaction between the (A) and (B) to control a molecular weight of the resultant urea-modified polyester. Specific examples of the reaction terminators include monoamines such as diethylamine, dibutylamine, butylamine and laurylamine; and their blocked compounds such as ketimine compounds.

The weight-average molecular weight of the urea-modified polyester is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester can be included as a toner binder with the urea-modified polyester. A combination thereof improves low temperature fixability of the resultant toner and glossiness of color images produced thereby, and the combination is more preferably used than using the urea-modified polyester alone. Further, the unmodified polyester may include modified polyester except for the urea-modified polyester.

It is preferable that the urea-modified polyester at least partially mixes with the unmodified polyester to improve the low temperature fixability and hot offset resistance of the resultant toner. Therefore, the urea-modified polyester preferably has a structure similar to that of the unmodified polyester.

A mixing ratio between the unmodified polyester and urea-modified polyester is from 20/80 to 95/5, preferably from 70/30 to 95/5, more preferably from 75/25 to 95/5, and even more preferably from 80/20 to 93/7. When the urea-modified polyester is less than 5%, the hot offset resistance deteriorates, and in addition, it is disadvantageous to have both high temperature preservability and low temperature fixability.

In the present invention, the binder resin including the unmodified polyester and urea-modified polyester preferably has a glass transition temperature (Tg) of from 45 to 65° C., and preferably from 45 to 60° C. When the glass transition temperature is less than 45° C., the high temperature preservability of the toner deteriorates. When higher than 65° C., the low temperature fixability deteriorates.

As the urea-modified polyester is present on a surface of the toner particle, the resultant toner has better heat resistance preservability than known polyester toners even though the glass transition temperature of the urea-modified polyester is low.

Suitable colorants for use in the toner of the present invention include known dyes and pigments. Specific examples of the colorants include carbon black, Nigrosine dyes, black iron oxide, NAPHTHOL YELLOW S, HANSA YELLOW (10G, 5G and G), Cadmium Yellow, yellow iron oxide, bess, chrome yellow, Titan Yellow, polyazo yellow, Oil Yellow, HANSA YELLOW (GR, A, RN and R), Pigment Yellow L, BENZIIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux SB, Toluidine Maroon, Permanent Bordeaux PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naplithol Green B, Green Gold, Acid Green Lake, Malachite Green Lake, Phthalocyanine Green, Anthraquinone Green, titanium oxide, zinc oxide, lithopone and the like. These materials are used alone or in combination. A content of the colorant in the toner is preferably from 1 to 15% by weight, and more preferably from 3 to 10% by weight, based on total weight of the toner.

The colorant for use in the present invention can be used as a master batch pigment when combined with a resin.

Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; or their copolymers with vinyl compounds; polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

A wax for use in the toner of the present invention as a release agent has a low melting point of from 50 to 120° C. When such a wax is included in the toner, the wax is dispersed in the binder resin and serves as a release agent at a location between a fixing roller and the toner particles. Thereby, hot offset resistance can be improved without applying an oil to the fixing roller used. Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-lauryl-methacrylate and n-stearyl acrylate-ethyl methacrylate copolymers, can also be used.

These charge controlling agent and release agents can be dissolved and dispersed after kneaded upon application of heat together with a master batch pigment and a binder resin, and can be added when directly dissolved and dispersed in an organic solvent.

The toner of the present invention is produced by the following method, but the method is not limited thereto.

1) A colorant, an unmodified polyester, a polyester prepolymer having an isocyanate group (A) and a release agent are dispersed in an organic solvent to prepare a toner constituent liquid.

The organic solvent is preferably a volatile solvent having a boiling point less than 100° C. because of being easily removed after a toner particle is formed. Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, methyl ethylketone and methylisobutylketone. These can be used alone or in combination. Particularly, aromatic solvents such as the toluene and xylene and halogenated hydrocarbons such as the methylene chloride, 1,2-dichloroethane, chloroform and carbon tetrachloride. A content of the organic solvent is typically from 0 to 300 parts by weight, preferably from 0 to 100 parts by weight, and more preferably from 25 to 70 parts by weight per 100 parts by weight of the polyester prepolymer.

2) The toner constituent liquid is emulsified in an aqueous medium in the presence of a surfactant and a resin particulate material.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

A content of the water medium is typically from 50 to 2,000 parts by weight, and preferably from 100 to 1,000 parts by weight per 100 parts by weight of the toner constituent liquid. When the content is less than 50 parts by weight, the toner constituent liquid is not well dispersed and a toner particle having a predetermined particle diameter cannot be formed. When the content is greater than 2,000 parts by weight, the production cost increases.

A dispersant such as a surfactant and resin particulate material is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11}oxy)-1-alkyl(C3-C4)sulfonate, sodium-{omega-fluoroalkanoyl(C6-C8)-N-ethylamino}-1-propane sulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.;

UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300. (from Neos); etc.

The resin particulate material is included to stabilize a toner particle formed in the aqueous medium. Therefore, the resin particulate material is preferably included so as to have a coverage of from 10 to 90% over a surface of the toner particle. Specific examples of the resin particulate materials include polymethylmethacrylate fine particles having particle diameters of 1 μm and 3 μm, polystyrene fine particles having particle diameters of 0.5 μm and 2 μm and a polystyrene-acrylonitrile fine particle having a particle diameter of 1 μm. These are marketed as PB-200 from Kao Corporation, SGP from Soken Chemical & Engineering Co., Ltd., Technopolymer SB from Sekisui Plastics Co., Ltd., SGP-3G from Soken Chemical & Engineering Co., Ltd. and Micro Pearl from Sekisui Chemical Co., Ltd.

In addition, inorganic dispersants such as tricalcium phosphate, calcium carbonate, titanium oxide, colloidal silica and hydroxy apatite can also be used.

As dispersants which can be used in combination with the above-mentioned resin fine particles and inorganic compounds, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid. When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

3) While an emulsion is prepared, amines (B) are included therein to be reacted with the polyester prepolymer (A) having an isocyanate group.

This reaction is accompanied by a crosslinking and/or a elongation of a molecular chain. The reaction time depends on reactivity of an isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

4) After the reaction is terminated, an organic solvent is removed from an emulsified dispersion (a reactant), which is washed and dried to form a toner particle.

The prepared emulsified dispersion (reactant) is gradually heated while stirred in a laminar flow, and an organic solvent is removed from the dispersion after stirred strongly when the dispersion has a specific temperature to from a toner particle having a shape of spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

Before or after the above-mentioned washing and desolvent process, a process of leaving the emulsified dispersion at a predetermined temperature and for a predetermined period of time to age the toner can be made, by which the resultant toner has a desired particle diameter. The predetermined temperature is preferably from 25 to 50° C., and the predetermined period of time is preferably from 10 min to 23 hrs.

5) A charge controlling agent is beat in the toner particle, and inorganic fine particles such as silica fine particles and titanium oxide fine particles are externally added thereto to form a toner.

An embodiment of the present invention is disposing the toner between 10 mm and 23 hrs at a temperature of between 25 and 50° C. after being granulated in the liquid medium.

Known methods using a mixer, etc. are used to beat in the charge controlling agent and to externally add the inorganic fine particles.

Thus, a toner having a small particle diameter and a sharp particle diameter distribution can be obtained. Further, the strong agitation in the process of removing the organic solvent can control a shape of the toner from a spheric shape to a spindle shape.

The toner of the present invention can be used for a two-component developer in which the toner is mixed with a magnetic carrier. A content of the toner is preferably from 1 to 10 parts by weight per 100 parts by weight of the carrier.

Specific examples of the magnetic carrier include known carrier materials such as iron powders, ferrite powders, magnetite powders, magnetic resin carriers, which have a particle diameter of from about 20 to about 200 μm. A surface of the carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or non-magnetic developer without a carrier.

Inorganic fine particles such as a hydrophobic silica fine powder may be further included in the developer to improve fluidity, preservability, developability and transferability thereof. Typical powder mixers are used to mix an external additive, and the mixer preferably has a jacket and can control an inner temperature thereof. To change a loading record for the external additive, the external additive may be included on the way of the mixing process or gradually included. Needless to say, a rotation number, a rolling speed, a mixing time and a mixing temperature of the mixer may be changed. First a strong load and next comparatively a weak load, or vice versa may be applied to the external additive.

Specific examples of the mixers include a V-type mixer, a locking mixer, a Loedige Mixer, a Nauter Mixer, a HENSCHEL MIXER, etc.

An image forming apparatus using the toner of the present invention as a developer.

FIGURE is a schematic view illustrating an embodiment of the image forming apparatus of the present invention. An image forming apparatus 100 is formed of an original reader 20, an image former 30 and a paper feeder 40. The image former 30 includes a photoreceptor 1 which is an image bearer, and a charger 2, an irradiator 3, an image developer 4, a transferer 6, a fixer 7 and a cleaner 8 around the photoreceptor 1. The charger 2 uniformly charges a surface of the photoreceptor 1, the irradiator 3 irradiates the charged surface thereof to form an electrostatic latent image, the image developer 4 feeds a toner having a same polarity as that of the latent image to form a toner image, and then the transferer 6 transfers the toner image onto a recording member such as papers fed from the paper feeder 40. The recording member is then transported to the fixer 7 fixing the toner image thereon with a heat and a pressure. On the other hand, the toner remaining on the photoreceptor 1 after the toner image is transferred onto the recording member is removed by the cleaner 8.

The image developer 4 uses s developer including the toner of the present invention. The image developer 4 applies an alternate electric field to the photoreceptor 1 from an opposite location thereto to develop the latent image thereon with a developer borne by a developer bearer 4*a*. The application of the alternate electric field activates the developer, narrows charge amount distribution of the toner and improves developability thereof.

In the FIGURE, the fixer is configured to fix the visual toner image on the transfer body.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The following magnetic carrier was commonly used for a two-component developer in each Example.

The following coating materials were dispersed by a stirrer for 10 min to prepare a coating liquid.

| | |
|---|---|
| Toluene | 450 |
| Silicone resin SR2400 having a nonvolatile matter of 50% from Dow Corning Toray Silicone Co., Ltd. | 450 |
| Amino silane SH6020 from Dow Corning Toray Silicone Co., Ltd. | 10 |
| Carbon black | 10 |

The coating liquid was coated on the following core material by a coater coating while forming a spiral flow with a rotational bottom board disc and a stirring blade in a fluidizing bed.

Cu—Zn Ferrite particle 5,000

The coated material was calcined in an electric oven at 250° C. for 2 hrs to prepare a carrier coated with the silicone resin having an average layer thickness of 0.5 μm.

100 parts of the carrier and 7 parts of each color toner in the following Examples were uniformly mixed by a Turbula mixer rolling a container to stir a mixture so as to be charged to form a developer.

Example 1

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 30 min at 3,800 rpm to prepare a white emulsion therein. The white emulsion was heated to have a temperature of 75° C. and reacted for 4 hrs. Further, 30 parts of an aqueous solution of persulfate ammonium having a concentration of 1% were added thereto and the mixture was reacted for 6 hrs at 75° C. to prepare an aqueous dispersion [a particulate dispersion liquid 1] of a vinyl resin (a copolymer of a sodium salt of an adduct of styrene-methacrylate-butylacrylate-sulfuric ester with ethyleneoxide methacrylate). The particulate dispersion liquid 1 was measured by LA-920 to find a volume-average particle diameter thereof was 0.10 μm. A part of the particulate dispersion liquid 1 was dried to isolate a resin component therefrom. The resin component had a Tg of 58° C. and a weight-average molecular weight of 130,000.

990 parts of water, 83 parts of the particulate dispersion liquid 1, 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid [an aqueous phase 1].

724 parts of an adduct of bisphenol A with 2 moles of ethyleneoxide and 276 parts terephthalic acid were polycondensated in a reactor vessel including a cooling pipe, a stirrer and a nitrogen inlet pipe for 7 hrs at a normal pressure and 230° C. Further, after the mixture was depressurized by 10 to 15 mmHg and reacted for 5 hrs to prepare low-molecular-weight polyester 1. The low-molecular-weight polyester 1 had a number-average molecular weight of 2,300, a weight-average molecular weight of 6,700, a peak molecular weight of 3,800, a Tg of 43° C. and an acid value of 4.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 7 hrs at a normal pressure and 230° C. Further, after the mixture was depressurized by 10 to 15 mm Hg and reacted for 5 hrs to prepare an intermediate polyester 1. The intermediate polyester 1 had a number-average molecular weight of 2,200, a weight-average molecular weight of 9,700, a peak molecular weight of 3,000, a Tg of 54° C. and an acid value of 0.5 and a hydroxyl value of 52.

Next, 410 parts of the intermediate polyester 1, 89 parts of isophoronediisocyanate and 500 parts of ethyl acetate were reacted in a reactor vessel including a cooling pipe, a stirrer and a nitrogen inlet pipe for 5 hrs at 100° C. to prepare a prepolymer 1. The prepolymer 1 included a free isocyanate in an amount of 1.53% by weight.

170 parts of isophorondiamine and 75 parts of methyl ethyl ketone were reacted at 50° C. for 4 hrs in a reaction vessel including a stirrer and a thermometer to prepare a ketimine compound 1. The ketimine compound 1 had an amine value of 417.

1,200 parts of water, 540 parts of carbon black Printex 35 from Degussa A.G. having a DBP oil absorption of 42 ml/100 mg and a pH of 9.5, 1,200 parts of a polyester resin were mixed by a HENSCHEL MIXER from Mitsui Mining Co., Ltd. After the mixture was kneaded by a two-roll mu having a surface temperature of 130° C. for 1 hr, the mixture was extended by applying pressure, cooled and pulverized by a pulverizer to prepare a master batch 1.

378 parts of the low-molecular-weight polyester 1, 100 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the master batch 1 and 500 parts of ethyl acetate were added to the mixture and mixed for 1 hr to prepare a material solution 1.

1,324 parts of the material solution 1 were transferred into another vessel, and the carbon black and wax therein were dispersed by a beads mill (Ultra Visco Mill from IMECS CO., LTD.) for 3 passes under the following conditions:

liquid feeding speed of 1 kg/hr
peripheral disc speed of 6 m/sec, and
filling zirconia beads having diameter 0.5 mm
for 80% by volume.

Next, 1,324 parts of an ethyl acetate solution of the low-molecular-weight polyester 1 having a concentration of 65% were added to the material solution 1 and the mixture was stirred by the beads mill for 2 passes under the same conditions to prepare a pigment and wax dispersion liquid 1. The pigment and wax dispersion liquid 1 had a solid content concentration of 50%.

749 parts of the pigment and wax dispersion liquid 1, 115 parts of the prepolymer 1 and 2.9 parts of the ketimine compound 1 were mixed in a vessel by a TK-type homomixer from Tokushu Kika Kogyo Co., Ltd. at 5,000 rpm for 2 min. 1,200 parts of the aqueous phase 1 were added to the mixture and mixed by the TK-type homomixer at 13,000 rpm for 25 min to prepare an emulsified slurry 1.

The emulsified slurry 1 was put in a vessel including a stirrer and a thermometer. After a solvent was removed from the emulsified slurry 1 at 30° C. for 7 hrs, the slurry was aged at 45° C. for 7 hrs to prepare a dispersion slurry 1.

After the dispersion slurry 1 was filtered under reduced pressure, 100 parts of ion-exchange water were added to the filtered cake and mixed by the TK-type homomixer at 12,000 rpm for 10 min, and the mixture was filtered.

Further, 1% sodium hydrate was added to the filtered cake such that the mixture has a pH of from 3.5 to 4.5 and mixed by the TK-type homomixer at 12,000 rpm for 15 min, and the mixture was filtered under reduced pressure.

Further, 300 parts of ion-exchange water were added to the filtered cake and mixed by the TK-type homomixer at 12,000 rpm for 10 min, and the mixture was filtered. This operation was repeated for twice to prepare a filtered cake 1.

The filtered cake 1 was dried by an air drier at 45° C. for 48 hrs and sieved by a mesh having an opening of 75 μm to prepare a toner particle 1. Each 1 part of hydrophobic silica and hydrophobic titanium oxide were mixed with 100 parts of the toner particle 1 by a HENSCHEL MIXER to prepare a toner 1. Properties and evaluation results of the toner 1 are shown in Tables 1 and 2 respectively.

Example 2

The procedures for preparation of the toner 1 in Example 1 were repeated except that the white emulsion was heated to have a temperature of 75° C. and reacted for 1 hr to prepare a toner 2. The resin component had a Tg of 56° C. and a weight-average molecular weight of 120,000.

Properties and evaluation results of the toner 2 are shown in Tables 1 and 2 respectively.

Example 3

The procedures for preparation of the toner 1 in Example 1 were repeated except that 1,200 parts of the aqueous phase 1 were added to the mixture and mixed by the TK-type homomixer at 13,000 rpm for 10 min to prepare an emulsified slurry 2 and that the slurry was aged at 45° C. for 5 hrs to prepare a dispersion slurry 2 after a solvent was removed therefrom at 30° C. for 6 hrs to prepare a toner 3.

Properties and evaluation results of the toner 3 are shown in Tables 1 and 2 respectively.

Example 4

The procedures for preparation of the toner 1 in Example 1 were repeated except that 1,200 parts of the aqueous phase 1 were added to the mixture and mixed by the TK-type homomixer at 13,000 rpm for 40 min to prepare an emulsified slurry 3 and that the slurry was aged at 45° C. for 5 hrs to prepare a dispersion slurry 3 after a solvent was removed therefrom at 30° C. for 8 hrs to prepare a toner 4.

Properties and evaluation results of the toner 4 are shown in Tables 1 and 2 respectively.

Example 5

The procedures for preparation of the toner 1 in Example 1 were repeated to prepare a toner 5 except for the following procedures.

378 parts of the low-molecular-weight polyester 1, 100 parts of carnauba/rice wax (a weight ratio 5:5) and 947 parts of ethyl acetate were mixed in a reaction vessel including a stirrer and a thermometer, and the mixture was heated to have a temperature of 80° C. while stirred. After the temperature of 80° C. was maintained for 4 hrs, the mixture was cooled to have a temperature of 30° C. in an hour, and then 500 parts of the master batch 1 and 500 parts of ethyl acetate were added to the mixture and mixed for 2 hrs to prepare a material solution 2. 1,324 parts of the material solution 2 were transferred into another vessel, and the carbon black and wax therein were dispersed by a beads mill (Ultra Visco Mill from IMECS CO., LTD.) for 10 passes under the following conditions:

liquid feeding speed of 1 kg/hr
peripheral disc speed of 6 m/sec, and
filling zirconia beads having diameter 0.5 mm for 80% by volume.

Next, 1,324 parts of an ethyl acetate solution of the low-molecular-weight polyester 1 having a concentration of 65% were added to the material solution 2 and the mixture was stirred by the beads mill for 5 passes under the same conditions to prepare a pigment and wax dispersion liquid 2. The pigment and wax dispersion liquid 2 had a solid content concentration of 50%.

Properties and evaluation results of the toner 5 are shown in Tables 1 and 2 respectively.

Example 6

The procedures for preparation of the toner 1 in Example 1 were repeated to prepare a toner 6 except for the following procedures.

378 parts of the low-molecular-weight polyester 1, 100 parts of carnauba/rice wax (a weight ratio 3:7) and 947 parts of ethyl acetate were mixed in a reaction vessel including a stirrer and a thermometer, and the mixture was heated to have a temperature of 80° C. while stirred. After the temperature of 80° C. was maintained for 4 hrs, the mixture was cooled to have a temperature of 30° C. in an hour, and then 500 parts of the master batch 1 and 500 parts of ethyl acetate were added to the mixture and mixed for 0.8 hrs to prepare a material solution 3. 1,324 parts of the material solution 3 were transferred into another vessel, and the carbon black and wax therein were dispersed by a beads mill (Ultra Visco Mill from IMECS CO., LTD.) for 5 passes under the following conditions:

liquid feeding speed of 1 kg/hr
peripheral disc speed of 6 m/sec, and
filling zirconia beads having diameter 0.5 mm for 80% by volume.

Next, 1,324 parts of an ethyl acetate solution of the low-molecular-weight polyester 1 having a concentration of 65% were added to the material solution 3 and the mixture was stirred by the beads mill for 3 passes under the same conditions to prepare a pigment and wax dispersion liquid 3. The pigment and wax dispersion liquid 3 had a solid content concentration of 50%.

Properties and evaluation results of the toner 6 are shown in Tables 1 and 2 respectively.

Example 7

The procedures for preparation of the toner 1 in Example 1 were repeated to prepare a toner 7 except for the following procedures.

229 parts of an adduct of bisphenol A with 2 moles of ethyleneoxide, 529 parts of an adduct of bisphenol A with 3 moles of propyleneoxide, 208 parts of terephthalic acid, 46 parts of adipic acid and 2 parts of dibutyltinoxide were mixed and reacted in a reactor vessel including a cooling pipe, a stirrer and a nitrogen inlet pipe for 7 hrs at a normal pressure and 230° C. Further, after the mixture was depressurized by 10 to 15 mm Hg and reacted for 5 hrs, 44 parts of trimellitic acid anhydride were added thereto and reacted for 3 hrs at 180° C. and a normal pressure to prepare low-molecular-weight polyester 2. The low-molecular-weight polyester 2 had a number-average molecular weight of 2,300, a weight-average molecular weight of 6,700, a peak molecular weight of 3,100, a Tg of 43° C. and an acid value of 25.

378 parts of the low-molecular-weight polyester 2, 100 parts of carnauba wax and 947 parts of ethyl acetate were mixed in a reaction vessel including a stirrer and a thermometer, and the mixture was heated to have a temperature of 80° C. while stirred. After the temperature of 80° C. was maintained for 5 hrs, the mixture was cooled to have a temperature of 30° C. in an hour, and then 500 parts of the master batch 1 and 500 parts of ethyl acetate were added to the mixture and mixed for 0.8 hrs to prepare a material solution 4. 1,324 parts of the material solution 4 were transferred into another vessel, and the carbon black and wax therein were dispersed by a beads mill (Ultra Visco Mill from IMECS CO., LTD.) for 3 passes under the following conditions:

liquid feeding speed of 1 kg/hr
peripheral disc speed of 6 m/sec, and
filling zirconia beads having diameter 0.5 mm for 80% by volume.

Next, 1,324 parts of an ethyl acetate solution of the low-molecular-weight polyester 2 having a concentration of 65% were added to the material solution 3 and the mixture was stirred by the beads mill for 3 passes under the same conditions to prepare a pigment and wax dispersion liquid 4. The pigment and wax dispersion liquid 4 had a solid content concentration of 50%.

749 parts of the pigment and wax dispersion liquid 4, 115 parts of the prepolymer 1 and 2.9 parts of the ketimine compound 1 were mixed in a vessel by a TK-type homomixer from Tokushu Kika Kogyo Co., Ltd. at 5,000 rpm for 2 min. 1,200 parts of the aqueous phase 1 were added to the mixture and mixed by the TK-type homomixer at 13,000 rpm for 40 min to prepare an emulsified slurry 4.

The emulsified slurry 4 was put in a vessel including a stirrer and a thermometer. After a solvent was removed from the emulsified slurry 1 at 30° C. for 8 hrs, the slurry was aged at 45° C. for 5 hrs to prepare a dispersion slurry 4.

Properties and evaluation results of the toner 7 are shown in Tables 1 and 2 respectively.

Example 8

The procedures for preparation of the toner 1 in Example 1 were repeated to prepare a toner 8 except for the following procedures.

378 parts of the low-molecular-weight polyester 1, 380 parts of carnauba and 947 parts of ethyl acetate were mixed in a reaction vessel including a stirrer and a thermometer, and the mixture was heated to have a temperature of 80° C. while stirred. After the temperature of 80° C. was maintained for 4 hrs, the mixture was cooled to have a temperature of 30° C. in an hour, and then 500 parts of the master batch 1 and 500 parts of ethyl acetate were added to the mixture and mixed for 2 hrs to prepare a material solution 5. 1,324 parts of the material solution 3 were transferred into another vessel, and the carbon black and wax therein were dispersed by a beads mill (Ultra Visco Mill from IMECS CO., LTD.) for 7 passes under the following conditions:

liquid feeding speed of 1 kg/hr peripheral disc speed of 6 m/sec, and filling zirconia beads having diameter 0.5 mm for 80% by volume.

Next, 1,324 parts of an ethyl acetate solution of the low-molecular-weight polyester 1 having a concentration of 65% were added to the material solution 4 and the mixture was stirred by the beads mill for 4 passes under the same conditions to prepare a pigment and wax dispersion liquid 5. The pigment and wax dispersion liquid 3 had a solid content concentration of 50%.

Properties and evaluation results of the toner 8 are shown in Tables 1 and 2 respectively.

Comparative Example 1

The procedures for preparation of the toner 1 in Example 1 were repeated except that an alkaline treatment process with sodium hydrate having a pH of 11 was made between the emulsification and de-solvent process to dissolve and remove organic resin fine particles on a surface of the toner to prepare a toner 9.

Properties and evaluation results of the toner 9 are shown in Tables 1 and 2 respectively.

Comparative Example 2

The procedures for preparation of the toner 7 in Example 7 were repeated to prepare a toner 10 except for the following procedures.

749 parts of the pigment and wax dispersion liquid 4, 115 parts of the prepolymer 1 and 2.9 parts of the ketimine compound 1 were mixed in a vessel by a TK-type homomixer from Tokushu Kika Kogyo Co., Ltd. at 5,000 rpm for 2 min. 1,200 parts of the aqueous phase 1 were added to the mixture and the mixture was left for 1 hr to prepare an emulsified slurry 5.

The emulsified slurry 5 was put in a vessel including a stirrer and a thermometer. After a solvent was removed from the emulsified slurry. 1 at 30° C. for 8 hrs to prepare a dispersion slurry 5.

Properties and evaluation results of the toner 10 are shown in Tables 1 and 2 respectively.

Comparative Example 3

The following materials were mixed, dissolved, dispersed and emulsified in a flask including 550 g of ion-exchange water including 6 g of a dissolved nonionic surfactant Nonipol 400 from Sanyo Chemical Industries, Ltd. and 10 g of a dissolved anionic surfactant Neogen SC from Dai-ichi Kogyo Seiyaku Co., Ltd.

| | |
|---|---|
| Styrene | 370 g |
| N-butylacrylate | 30 g |
| Acrylic acid | 8 g |
| Dodecanethiol | 24 g |
| Carbon tetrabromide | 4 g |

After 50 g of ion-exchange water including 4 g of dissolved ammonium persulfate were put in the emulsified mixture to perform a nitrogen substitution while slowly mixed for 10 min, the mixture in the flask was heated to have a temperature of 70° C. with an oil bath while stirred and the emulsion polymerization was continued for 5 hrs. Thus, a dispersion liquid (1) including a dispersed resin particle having an average particle diameter of 155 nm, a Tg of 59° C. and a weight-average molecular weight of 12,000 was prepared.

The following materials were mixed, dissolved, dispersed and emulsified in a flask including 550 g of ion-exchange water including 6 g of a dissolved nonionic surfactant Nonipol 400 from Sanyo Chemical Industries, Ltd. and 12 g of a dissolved anionic surfactant Neogen SC from Dai-ichi Kogyo Seiyaku Co., Ltd.

| | |
|---|---|
| Styrene | 280 g |
| N-butylacrylate | 120 g |
| Acrylic acid | 8 g |

After 50 g of ion-exchange water including 3 g of dissolved ammonium persulfate were put in the emulsified mixture to perform a nitrogen substitution while slowly mixed for 10 min, the mixture in the flask was heated to have a temperature of 70° C. with an oil bath while stirred and the emulsion polymerization was continued for 5 hrs. Thus, a dispersion liquid (2) including a dispersed resin particle having an average particle diameter of 105 nm, a Tg of 53° C. and a weight-average molecular weight of 550,000 was prepared.

The following materials were mixed, dissolved and dispersed by a homogenizer T50 from IKA-WERKE GMBH & CO., KG. for 10 min to prepare a colorant dispersion liquid (1) including a colorant (carbon black) having an average particle diameter of 250 nm.

| | |
|---|---|
| Carbon black (Mogal L from Cabot Corp.) | 50 g |
| Nonionic surfactant (Nonipol 400 from Sanyo Chemical Industries, Ltd. | 5 g |
| Ion-exchange water | 200 g |

After the following materials were heated at 95° C. and dispersed by a homogenizer T50 from IKA-WERKE GMBH & CO., KG., the mixture was dispersed by a pressure discharging homogenizer to prepare a release agent dispersion liquid 1 including a release agent having an average particle diameter of 550 nm.

| | |
|---|---|
| Paraffin wax (HNP0190 having a melting point of 85° C. from Nippon Seiro Co., Ltd.) | 50 g |
| Cationic surfactant (Sanisol B50 from Kao Corp.) | 5 g |
| Ion-exchange water | 200 g |

After the following materials were mixed and dispersed by homogenizer T50 from IKA-WERKE GMBH & CO., KG. in a round stainless flask, the mixture was heated to have a temperature of 48° C. while stirred in a heating oil bath.

| | |
|---|---|
| Dispersion liquid (1) | 120 g |
| Dispersion liquid (2) | 80 g |
| Colorant dispersion liquid (1) | 30 g |
| Release agent dispersion liquid (1) | 40 g |
| Cationic surfactant (Sanisol B50 from Kao Corp.) | 1.5 g |

After the mixture was maintained to have the temperature of 48° C. for 30 min, the mixture was observed by an optical microscope to find that agglomerated particles having an average particle diameter of about 5 μm and a volume of 95 $cm^3$ were formed.

Further, 60 g of the dispersion liquid (1) were gradually added into the mixture. The resin particles included in the dispersion liquid (1) had a volume of 25 $cm^3$. Then, the mixture was left for 1 hr after the temperature of the heating oil bath was raised to 50° C.

Then, after 3 g of the anionic surfactant Neogen SC from Dai-ichi Kogyo Seiyaku Co. were added into the mixture, the mixture was closed in the stainless flask and heated to have a temperature of 105° C. while stirred with a magnetic seal for 3 hrs. Then, after the mixture was cooled, a reaction product was filtered, fully washed with ion-exchange water and dried to prepare a toner particle. Then, each 1 part of hydrophobic silica and hydrophobic titanium oxide were mixed with 100 parts of the toner particle by a HENSCHEL MIXER to prepare a toner 11. Properties and evaluation results of the toner 11 are shown in Tables 1 and 2 respectively.

Comparative Example 4

In a reaction container with a condenser, a stirrer and a nitrogen introducing tube, 724 parts of an adduct of bisphenol A with 2 moles of ethyleneoxide, 276 parts of isophthalic acid and 2 parts of dibutyltinoxide were reacted for 8 hrs at 230° C. under a normal pressure. Then, after the reaction was further performed for 5 hrs under a reduced pressure of from 10 to 15 mmHg, the reaction product was cooled to have a temperature of 160° C. and 32 parts of phthalic anhydride were added thereto to further perform a reaction for 2 hrs. Then, the reaction production was cooled to have a temperature of 80° C. and mixed with 188 parts of isophorondiisocyanate in ethyl acetate and reacted for 2 hrs to prepare a prepolymer 2 including an isocyanate group. Next, 267 parts of the prepolymer 2 and 14 parts of isophoronediamine were reacted for 2 hrs at 50° C. to prepare a urea-modified polyester 1 having a weight-average molecular weight of 64,000.

Similarly, 724 parts of an adduct of bisphenol A with 2 moles of ethyleneoxide, 138 parts of terephthalic acid and 138 parts of isophthalic acid were polycondensated for 6 hrs at 230° C. under a normal pressure. Then, after the reaction was further performed for 5 hrs under a reduced pressure of from 10 to 15 mmHg to prepare an unmodified polyester a having a peak molecular weight of 2,300, a hydroxyl value of 55 and an acid value of 1.

200 parts of the urea-modified polyester 1 and 800 parts of the unmodified polyester a were dissolved and mixed in 1,000 parts of a mixed solvent including ethyl acetate/MEK (1/1) to prepare an acetate/MEK liquid solution including a toner binder. In a reaction container with a condenser, a stirrer and a thermometer, 1,000 parts of acetate/MEK liquid solution including a toner binder were added to 942 parts of water and 58 parts of a slurry including hydroxy apatite by 10% (Supertite 10 from Nippon Chemical Industrial Co., Ltd.) while stirred, and dispersed. Then, the dispersed materials were heated to have a temperature of 98° C. and an organic solvent was removed therefrom, and cooled, filtered, washed and dried to prepare a toner binder 1.

After 100 parts of the toner binder 1, 7 parts of glycerinetribehenate and 4 parts of cyanine blue KRO from SANYO COLOR WORKS, Ltd. were premixed by a HENSCHEL MIXER FM10B from Mitsui Mining Co., Ltd., the mixture was kneaded by a biaxial kneader PCM-30 from Jkegai Corp. Then, after the mixture was pulverized by a ultrasonic jet pulverizer Labojet from Nippon Pneumatic Mfg. Co., Ltd., the mixture was classified by a stream classifier MDS-I from Nippon Pneumatic Mfg. Co., Ltd. to prepare a toner particle. Then, each 1 part of hydrophobic silica and hydrophobic titanium oxide were mixed with 100 parts of the toner particle by a HENSCHEL MIXER to prepare a toner 12. Properties and evaluation results of the toner 12 are shown in Tables 1 and 2 respectively.

Comparative Example 5

In a reaction container with a condenser, a stirrer and a nitrogen introducing tube, 724 parts of an adduct of bisphenol A with 2 moles of ethyleneoxide, 276 parts of isophthalic acid and 2 parts of dibutyltinoxide were reacted for 8 hrs at 230° C. under a normal pressure. Then, after the reaction was further performed for 5 hrs under a reduced pressure of from 10 to 15 mmHg, the reaction product was cooled to have a temperature of 160° C. and 74 parts of phthalic anhydride were added thereto to further perform a reaction for 2 hrs. Then, the reaction production was cooled to have a temperature of 80° C. and mixed with 174 parts of ethyleneglycoldiglycidylether in toluene and reacted for 2 hrs to prepare a prepolymer 3 including an epoxy group and having a weight-average molecular weight of 13,000.

30 parts of isophorondiamine and 70 parts of MEK were reacted at 50° C. for 5 hrs in a reaction vessel including a stirrer and a thermometer to prepare a ketimine compound 2.

Similarly, 654 parts of an adduct of bisphenol A with 2 moles of ethyleneoxide and 516 parts of dimethylterephthalate ester were polycondensated for 6 hrs at 230° C. The reaction was further performed for 5 hrs under a reduced pressure of from 10 to 15 mmHg while dehydrating the reaction product to prepare a dead polymer 1 having a peak molecular weight of 2,400 and a hydroxyl value of 2.

15.4 parts of the prepolymer 3, 64 parts of the dead polymer 1 and 78.6 parts of ethyl acetate were stirred and dissolved in a beaker. Next, 20 parts of pentaerythritoltetrabehenate and 4 parts of cyanine blue KRO from SANYO COLOR WORKS, Ltd. were uniformly dissolved and dispersed in the mixture by a TK-type homomixer at 60° C. and 12,000 rpm. Then, 2.7 parts of the ketimine compound 2 was added to and dissolved in the mixture to prepare a toner constituent solution (1).

706 parts of ion-exchange water, 294 parts of a slurry including hydroxy apatite by 10 % (Supertite 10 from Nippon Chemical Industrial Co., Ltd.) 0.2 parts of sodium dodecylbenzenesulfonate were uniformly dissolved in a beaker. The mixture was heated to have a temperature of 60° C. and the toner constituent solution (1) was added thereto while stirred by a TK-type homomixer at 12,000 rpm for 10 min. The mixture was then transferred into a flask having a stirrer and a thermometer and heated to have a temperature of 98° C., and a solvent was removed from the mixture. After the mixture was filtered, washed and dried, the mixture was classified by a wind classifier to prepare a toner particle. Then, each 1 part of hydrophobic silica and hydrophobic titanium oxide were mixed with 100 parts of the toner particle by a HENSCELEL MIXER to prepare a toner 13. The toner binder component had a weight-average molecular weight of 14,000, a number-average molecular weight of 2,000 and a Tg of 52° C. Properties and evaluation results of the toner 13 are shown in Tables 1 and 2 respectively.

Comparative Example 6

The following materials were stirred in a flask with a stirrer, a condenser, a thermometer and a nitrogen introducing tube.

| | |
|---|---|
| Methanol | 300 g |
| Toluene | 100 g |
| Styrene | 570 g |
| 2-acrylamide-2-methylpropane sulfonic acid | 30 g |
| Lauroyl peroxide | 12 g |

The mixture was polymerized for 10 hrs at 65° C. while nitrogen was introduced therein. After the reaction product was dried under a reduced pressure, the reaction product was pulverized by a jet mill to prepare an A polymer having a weight-average molecular weight of 3,000.

The following materials were uniformly dissolved or dispersed at 65° C. to prepare a monomer composition.

| | |
|---|---|
| Styrene | 183 |
| 2-ethylhexylacrylate | 17 |
| A polymer | 0.1 |
| C.I. Pigment Yellow 17 | 7 |
| Paraffin wax having a melting point of 155° F. | 32 |
| Initiator V-601 from Wako Pure Chemical Industries, Ltd. | 10 |

On the other hand, 0.3 g of a silane coupling agent KBE903 from Shin-Etsu Chemical Co., Ltd. were uniformly dispersed in 1,200 ml of ion-exchange water, and further 6 g of colloidal silica Aerosil #200 from Nippon Aerosil Co., Ltd. were uniformly dispersed therein. The dispersion liquid was blended with hydrochloric acid to have a pH of 6 to prepare a dispersion medium.

The monomer composition was put in the dispersion medium, and the monomer composition was granulated by a TK-type homomixer at 6,500 rpm and 70° C. in a nitrogen environment for 60 min. Then, the monomer composition was polymerized at 75° C. for 8 hrs while stirred with a paddle stirring blade.

After the polymerization was completed, the reaction product was cooled and 42 g of an aqueous solution including sodium hydrate by 20% by weight were added thereto, and left for 1 night. Then, the reaction product was filtered, washed and dried to prepare a toner 14. Properties and evaluation results of the toner 14 are shown in Tables 1 and 2 respectively.

The toner properties were evaluated as follows.

Surface Profile

As an atomic force microscope apparatus, a Nanoscope III controller and a D-3100/P system from Digital Instruments were used. The surface profile was measured and analyzed with a tapping mode. A Si single crystal (TESP) having a spring constant of 50 N/m and a resonance frequency of 270 kHz was used for a cantilever.

Circularity

A flow-type particle image analyzer FPIA-2000 from SYSMEX CORPORATION was used to measure an average circularity. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

Shape Factor

An image of the toner was photographed by a scanning electron microscope S-800 from Hitachi, Ltd. and the image was analyzed by an image analyzer LUSEX 3 from Nireco Corp. to compute the shape factor.

Average Particle Diameter and Particle Diameter Distribution

The volume-average and number-average particle diameter of the toner were measured by Coulter Counter COULTER COUNTER TA-II from Coulter Electronics, Inc. connected with an interface producing number and volume particle diameter distributions from the Institute of Japanese Union of Scientists & Engineers and a personal computer PC9801 from NEC Corp.

The toner was evaluated as follows.

1) Cleanability

After 1,000 copies of a chart having an image area of 95% were produced, a residual toner after transfer on a photoreceptor after cleaned was adhered on a Scotch Tape from Sumitomo 3M Ltd. and transferred onto a white paper. Density of the white paper was measured by Macbeth reflection densitometer RD514. When a density difference between the white paper the residual toner was transferred to and a blank white paper was less than 0.005, the cleanability was determined as ⊚. From 0.005 to 0.010 was ○, from 0.011 to 0.02 was Δ and greater than 0.02 was X.

2) Transferability

After an image of a chart having an image area of 20% was transferred onto a paper from a photoreceptor, a residual toner on a photoreceptor just before cleaned was adhered on a Scotch Tape from Sumitomo 3M Ltd. and transferred onto a white paper. Density of the white paper was measured by Macbeth reflection densitometer RD514. When a density difference between the white paper the residual toner was transferred to and a blank white paper was less than 0.005, the cleanability was determined as ⊚. From 0.005 to 0.010 was ○, from 0.011 to 0.02 was Δ and greater than 0.02 was X.

3) Charged Stability

Before and after 100,000 copies of a chart having an image area of 5% were continuously produced by IPSio Color 8100 from Ricoh Company, Ltd. modified to have an oilless fixer, a charged amount of 1 g of the developer was measured by a blow-off method. A variation of the charge amount of not greater than 5 μc/g was ○, not greater than 10 μc/g was Δ and greater than 10 μc/g was X.

4) Image Density

After a solid image having a toner amount of 0.4±0.1 mg/cm$^2$ was produced on a plain paper 6200 from Ricoh Company, Ltd. by Imagio Neo 450 from Ricoh Company, Ltd. modified to have a belt-type fixer, the image density was measured by X-Rite from X-Rite, Inc. The Image density not less than 1.4 was ○ and less than that was X.

5) Image Granularity and Sharpness

A mono-color image produced by IPSio Color 8100 from Ricoh Company, Ltd. modified to have an oilless fixer was visually observed to evaluate the image granularity and sharpness. ⊚ was as good as an offset printing, ○ was slightly worse than the offset printing, Δ was considerably worse than the offset printing and X was very poor.

6) Foggy Image

After 100,000 copies of a chart having an image area of 5% were continuously produced by IPSio Color 8100 from Ricoh Company, Ltd. modified to have an oilless fixer at 10° C. and a humidity of 15%, the background of the last image was visually observed to evaluate the toner contamination thereon. ⊚ means that no toner contamination was observed, ○ means a slight contamination without problems, Δ means a contamination was observed and X means an unacceptable contamination with serious problems.

7) Toner Scattering

After 100,000 copies of a chart having an image area of 5% were continuously produced by IPSio Color 8100 from Ricoh Company, Ltd. modified to have an oilless fixer at 40° C. and a humidity of 90%, the toner contamination in IPSio Color 8100 was visually observed. ⊚ means that no toner contamination was observed, ○ means a slight contamination without problems, Δ means a contamination was observed and X means an unacceptable contamination with serious problems.

8) Environmental (Blocking) Resistance 10 g of the toner was put in a glass container having a capacity of 20 ml and the glass container was tapped for 100 times. Then, after the glass container was left in a constant temperature bath having a temperature of 55° C. and a humidity of 80% for 24 hrs, a penetration of the toner was measured by a penetrometer. A penetration thereof left in an environment of low temperature and low humidity was also measured. A smaller penetration in either of the high temperature and humidity environment and the low temperature and humidity environment was used to evaluate. The larger the better. ⊚ was not less than 20 mm, ○ was not less than 15 mm and less than 20 mm, Δ was not less than 10 mm and less than 15 mm and X was less than 10 mm.

The properties and evaluation results of the toners in Examples and Comparative Examples are shown in Tables 1 and 2 respectively.

TABLE 1

| | SP | | | C | | SF | | PD | | | |
|---|---|---|---|---|---|---|---|---|---|---|---|
| | Ra (nm) | RMS (nm) | NC (pcs/μm) | AC | 0.93 (%) | SF-2 | Ra/SF-2 | Dv (μm) | Dn (μm) | Dv/Dn | Ra/Dv |
| Ex. 1 | 20 | 50 | 7 | 0.97 | 10 | 120 | 0.17 | 5.1 | 3.8 | 1.34 | 3.92 |
| Ex. 2 | 1.5 | 15 | 2 | 0.96 | 15 | 115 | 0.01 | 4.8 | 4.2 | 1.14 | 0.31 |
| Ex. 3 | 28 | 21 | 15 | 0.98 | 28 | 135 | 0.21 | 2.4 | 2.1 | 1.14 | 11.67 |
| Ex. 4 | 17 | 83 | 17 | 0.93 | 4 | 127 | 0.13 | 5.9 | 5.2 | 1.13 | 2.88 |
| Ex. 5 | 24 | 46 | 6 | 0.92 | 25 | 139 | 0.17 | 5.5 | 4.5 | 1.22 | 4.36 |
| Ex. 6 | 18 | 75 | 10 | 0.93 | 33 | 138 | 0.13 | 5.7 | 3.9 | 1.46 | 3.16 |
| Ex. 7 | 23 | 81 | 3 | 0.97 | 8 | 118 | 0.19 | 6.2 | 5.1 | 1.22 | 3.71 |
| Ex. 8 | 3 | 24 | 4 | 0.94 | 24 | 141 | 0.02 | 6.7 | 5.4 | 1.24 | 0.45 |
| Com. Ex. 1 | 0.8 | 11 | 4 | 0.97 | 28 | 122 | 0.01 | 5.0 | 4.4 | 1.14 | 0.16 |
| Com. Ex. 2 | 32 | 13 | 2 | 0.95 | 10 | 138 | 0.23 | 4.3 | 3.7 | 1.16 | 7.44 |
| Com. Ex. 3 | 1.1 | 9 | 2 | 0.96 | 23 | 118 | 0.01 | 5.2 | 4.2 | 1.24 | 0.21 |
| Com. Ex. 4 | 28 | 93 | 18 | 0.94 | 29 | 139 | 0.20 | 3.2 | 2.8 | 1.14 | 8.75 |
| Com. Ex. 5 | 1.2 | 12 | 0 | 0.95 | 22 | 120 | 0.01 | 5.3 | 4.7 | 1.13 | 0.23 |
| Com. Ex. 6 | 29 | 81 | 24 | 0.96 | 18 | 123 | 0.24 | 4.1 | 3.5 | 1.17 | 7.07 |

SP: Surface profile
NC: Number of convexities
C: Circularity
AC: Average circularity
0.93: A ratio of the toner having a circularity less than 0.93
SF: Shape factor
PD: Particle diameter Ricoh Company, Ltd. modified to have an oilless fixer at 10°

TABLE 2

| | 1) | 2) | 3) | 4) | 5) | 6) | 7) | 8) |
|---|---|---|---|---|---|---|---|---|
| Ex. 1 | ○ | ○ | ○ | ○ | ○ | ○ | ○ | ○ |
| Ex. 2 | Δ | ◎ | Δ | ○ | ○ | Δ | ○ | Δ |
| Ex. 3 | ◎ | Δ | ○ | ○ | Δ | ○ | ◎ | ◎ |
| Ex. 4 | ◎ | Δ | ○ | ○ | ○ | ◎ | ○ | ○ |
| Ex. 5 | ◎ | ○ | ○ | ○ | Δ | ○ | ○ | ◎ |
| Ex. 6 | ◎ | ◎ | ○ | ○ | Δ | Δ | ○ | ◎ |
| Ex. 7 | ○ | ○ | Δ | ○ | Δ | ◎ | ○ | Δ |
| Ex. 8 | Δ | ○ | ○ | ○ | Δ | ○ | Δ | ◎ |
| Com. Ex. 1 | X | ○ | X | ○ | ○ | Δ | X | X |
| Com. Ex. 2 | ○ | X | ○ | X | Δ | X | Δ | ○ |
| Com. Ex. 3 | X | ○ | X | ○ | ○ | X | Δ | X |
| Com. Ex. 4 | ○ | X | ○ | X | Δ | X | Δ | X |
| Com. Ex. 5 | Δ | Δ | X | X | X | X | X | X |
| Com. Ex. 6 | Δ | X | X | X | Δ | X | X | X |

As shown in Tables 1 and 2, the toner having a surface profile specified in the present invention has good chargeability, developability and transferability. Further, the toner having a controlled circularity, a shape factor and a particle diameter in the present invention produces images without foggy images and toner scattering, and has a good cleanability and a good environmental resistance.

This document claims priority and contains subject matter related to Japanese Patent Application No. 2003-010902 filed on Jan. 20, 2003 incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles comprising:

a binder resin; and a colorant; and an inorganic particulate material disposed on a surface of the toner particles, wherein the toner particles have a surface roughness of between 1 and 30 nm, a standard deviation of the surface roughness of between 10 and 90 nm and include 1 to 20 convexities per 1 μm having a height not less than 10 nm, and include a convexity having a vertical interval not less than 10 nm between a bottom of a concavity and a top of the convexity between 1 and 20 pieces/μm in number, wherein the toner has an average circularity of between 0.93 and 1.00, and wherein the toner has a shape factor of between 100 and 140 and a ratio of the surface roughness to the shape factor of between 0.007 and 0.30.

2. The toner according to claim 1, wherein an amount not greater than 30% of the toner particles have a circularity less than 0.93.

3. The toner according to claim 1, wherein the toner has a volume-average particle diameter of between 2.0 and 6.0 μm and a ratio of the volume-average particle diameter to a number-average particle diameter of between 1.00 and 1.40.

4. The toner according to claim 3, wherein the toner has a ratio of a surface roughness to the volume-average particle diameter of between 0.2 and 6.0.

5. The toner according to claim 1, wherein the toner is granulated in a liquid medium.

6. The toner according to claim 5, wherein the liquid medium comprises a resin particulate material having a volume-average particle diameter of between 20 and 150 nm, and wherein the resin particulate material is disposed on a surface of the toner.

7. The toner according to claim 6, wherein the resin particulate material comprises a spherical shape.

8. The toner according to claim 6, wherein the resin particulate material comprises one of a spindle, disk, spindle disk and amorphous flat plate shape.

9. The toner according to claim 5, wherein the toner is disposed between 10 mm and 23 hrs at a temperature of between 25 and 50° C. after being granulated in the liquid medium.

10. The toner according to claim 1, further comprising:

a resin, wherein the resin is different from the binder resin and disposed on the surface of the toner particles.

11. The toner according to claim 1, wherein the toner particles comprise a release agent.

12. A two-component developer comprising:

the toner according to claim 1; and a magnetic carrier.

13. An image developer comprising:

an image developing unit containing the two-component developer according to claim 12 and configured to develop an electrostatic latent image on a photoreceptor with the developer to form a toner image.

14. An image forming apparatus comprising:

a latent image bearer configured to bear a latent image;

a charger configured to uniformly charge a surface of the latent image bearer;

an irradiator configured to irradiate the surface of the, latent image bearer based on image data to form an electrostatic latent image on the surface thereof;

the image developer according to claim 13;

a transferer configured to transfer the visual toner image to a transfer body; and a fixer configured to fix the visual toner image on the transfer body.

15. A one-component developer comprising:

the toner according to claim 1.

16. An image developer comprising:

an image developing unit containing the one-component developer according to claim 15 and configured to develop an electrostatic latent image on a photoreceptor with the developer to form a toner image.

17. An image forming apparatus comprising:

a latent image bearer configured to bear a latent image;

a charger configured to uniformly charge a surface of the latent image bearer;

an irradiator configured to irradiate the surface of the latent image bearer based on image data to form an electrostatic latent image on the surface thereof;

the image developer according to claim 16;

a transferer configured to transfer the visual toner image to a transfer body; and a fixer configured to fix the visual toner image on the transfer body.

* * * * *